US010753025B2

(12) United States Patent
Fujihara

(10) Patent No.: US 10,753,025 B2
(45) Date of Patent: Aug. 25, 2020

(54) EMBROIDERY FRAME TRANSPORT DEVICE

(71) Applicant: BROTHER KOGYO KABUSHIKI KAISHA, Nagoya-shi, Aichi-ken (JP)

(72) Inventor: Shinya Fujihara, Obu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 50 days.

(21) Appl. No.: 16/117,825

(22) Filed: Aug. 30, 2018

(65) Prior Publication Data

US 2018/0371662 A1 Dec. 27, 2018

Related U.S. Application Data

(63) Continuation of application No. PCT/JP2017/005282, filed on Feb. 14, 2017.

(30) Foreign Application Priority Data

Mar. 24, 2016 (JP) ..... 2016-059816

(51) Int. Cl.
*D05C 9/06* (2006.01)
*D05B 39/00* (2006.01)

(52) U.S. Cl.
CPC ..... *D05C 9/06* (2013.01); *D05B 39/00* (2013.01)

(58) Field of Classification Search
CPC ... D05C 9/04; D05C 9/06; D05C 7/04; D05C 1/02; D05C 1/04; D05B 39/00; D06C 3/00; D06C 3/08
See application file for complete search history.

(56) References Cited

U.S. PATENT DOCUMENTS 5,353,725 A * 10/1994 Sakakibara ..... D05C 9/04 112/103
5,555,828 A * 9/1996 Rowley ..... D05C 9/04 112/103

(Continued)

FOREIGN PATENT DOCUMENTS

DE 3201014 C1 * 10/1983
JP 2001-212390 A 8/2001

(Continued)

OTHER PUBLICATIONS

May 23, 2017 Search Report issued in International Patent Aplplication No. PCT/JP2017/005282.

(Continued)

*Primary Examiner* — Ismael Izaguirre
(74) *Attorney, Agent, or Firm* — Oliff PLC

(57) ABSTRACT

An embroidery frame transport device includes a carriage, an engagement mechanism, and a release member. The carriage is configured to detachably mount with a coupling portion of an embroidery frame. The engagement mechanism is configured to engage with the coupling portion by moving the embroidery frame in a mounting direction in a case where the coupling portion is mounted on the carriage, to restrict the embroidery frame from moving in a removing direction. The removing direction is in a direction opposite of the mounting direction. The engagement mechanism is provided on the carriage. The release member is configured to release engagement between the engagement mechanism and the coupling portion. The release member is provided on the carriage. The release member is configured to press the embroidery frame in the removing direction.

6 Claims, 15 Drawing Sheets

(56) References Cited

U.S. PATENT DOCUMENTS

| | | | | |
|---|---|---|---|---|
| 5,899,155 | A * | 5/1999 | Thoren | D05C 9/04 112/103 |
| 6,684,799 | B2 * | 2/2004 | Ninomiya | D05C 9/04 112/103 |
| 8,327,782 | B2 | 12/2012 | Tseng et al. | |
| 9,174,826 | B1 * | 11/2015 | Nieves | B66B 11/0253 |
| 9,194,070 | B2 * | 11/2015 | Kawaguchi | D05C 9/06 |
| 2005/0072346 | A1 * | 4/2005 | Shoji | D05C 9/04 112/103 |
| 2006/0011122 | A1 * | 1/2006 | Yoshida | D05C 9/04 112/470.14 |

FOREIGN PATENT DOCUMENTS

| | | | |
|---|---|---|---|
| JP | 2002-052283 | A | 2/2002 |
| JP | 2005-334030 | A | 12/2005 |
| JP | 2006-14800 | A | 1/2006 |

OTHER PUBLICATIONS

Sep. 25, 2018 International Preliminary Report on Patentability issued in International Patent Application No. PCT/JP2017/005282.

* cited by examiner

EMBROIDERY FRAME TRANSPORT DEVICE

CROSS-REFERENCE TO RELATED APPLICATION

This application is a continuation application of International Application No. PCT/JP2017/005282, filed Feb. 14, 2017, which claims priority from Japanese Patent Application No. 2016-059816, filed on Mar. 24, 2016. The disclosure of the foregoing application is hereby incorporated by reference in its entirety.

BACKGROUND

The present disclosure relates to an embroidery frame transport device that is configured to transport an embroidery frame.

An embroidery frame transport device is known that is used by being mounted on a sewing machine capably of embroidery sewing. The known embroidery frame transport device includes an engagement mechanism and a lock mechanism. The engagement mechanism disengagably engages a coupling portion of an embroidery frame with a carriage, and stops the coupling portion of the embroidery frame that has moved in a sliding direction at a predetermined position with a locking portion. The lock mechanism is supported on the carriage. A lock member can be switched between a press position that presses the coupling portion of the embroidery frame against the locking portion, and a release position that releases the pressing.

SUMMARY

With the known embroidery frame transport device, removing the embroidery frame from the embroidery frame transport device is troublesome because it requires that a user perform an operation of switching the lock member of the lock mechanism to the release position, as well as perform an operation of pulling out the embroidery frame in a predetermined direction.

Various embodiments of the broad principles derived herein provide an embroidery frame transport device in which the embroidery frame can be attached to and detached from the embroidery frame transport device by a simpler operation compared to the related art.

Embodiments provide an embroidery frame transport device that includes a carriage, an engagement mechanism, and a release member. The carriage is configured to detachably mount with a coupling portion of an embroidery frame. The engagement mechanism is configured to engage with the coupling portion by moving the embroidery frame in a mounting direction in a case where the coupling portion is mounted on the carriage, to restrict the embroidery frame from moving in a removing direction. The removing direction is in a direction opposite of the mounting direction. The engagement mechanism is provided on the carriage. The release member is configured to release engagement between the engagement mechanism and the coupling portion. The release member is provided on the carriage. The release member is configured to press the embroidery frame in the removing direction.

BRIEF DESCRIPTION OF THE DRAWINGS

Embodiments will be described below in detail with reference to the accompanying drawings in which.

DETAILED DESCRIPTION

Figure 1:
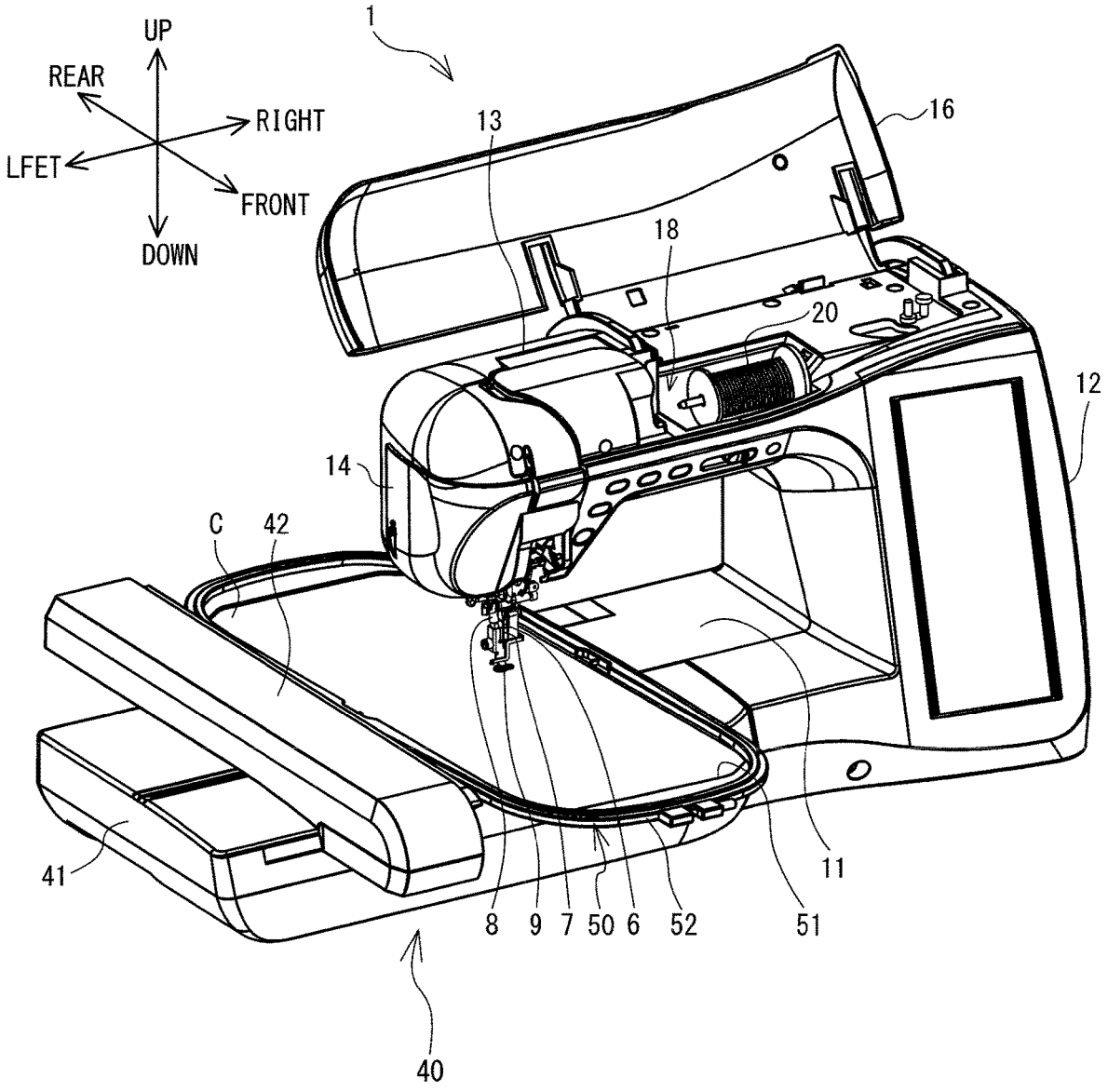
FIG. 1 is a perspective view of a sewing machine on which an embroidery frame transport device is mounted.

A first embodiment and a second embodiment of the present disclosure will be explained with reference to the drawings. A physical configuration of a sewing machine 1 on which an embroidery frame transport device (hereinafter referred to as the device) 40 is mounted will be explained with reference to FIG. 1 and FIG. 2. The up-down direction, the lower right side, the upper left side, the lower left side and the upper right side of FIG. 1 respectively correspond to the up-down direction, the front side, the rear side, the left side and the right side of the sewing machine 1 on which the device 40 is mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

A feed dog, a feed mechanism, a shuttle mechanism and the like, which are not shown in the drawings, are provided inside the bed portion 11 of the sewing machine 1. When normal sewing that is not embroidery sewing is performed, the feed dog is driven by the feed mechanism and moves the sewing object by a predetermined movement amount. The shuttle mechanism entwines an upper thread (not shown in the drawings) with a lower thread (not shown in the drawings) below a needle plate (not shown in the drawings) that is provided on an upper surface of the bed portion 11. The pillar 12 is internally provided with a sewing machine motor (not shown in the drawings). An upper portion of the arm portion 13 is provided with a cover 16 that can open and close. FIG. 1 shows the sewing machine 1 when the cover 16 is in an open state. A thread housing portion 18 is provided below the cover 16 (namely, inside the arm portion 13). The thread housing portion 18 can house a thread spool 20 around which the upper thread is wound. A drive shaft (not shown in the drawings) that extends in the left-right direction is provided inside the arm portion 13. The drive shaft is rotationally driven by the sewing machine motor. The head portion 14 is provided with a needle bar 6, a presser bar 8, and the like. The sewing needle 7 is detachably mounted on the lower end of the needle bar 6. A presser foot 9 is detachably attached to the lower end portion of the presser bar 8. The needle bar 6 is driven in the up-down direction by the rotation of the drive shaft.

Figure 2:
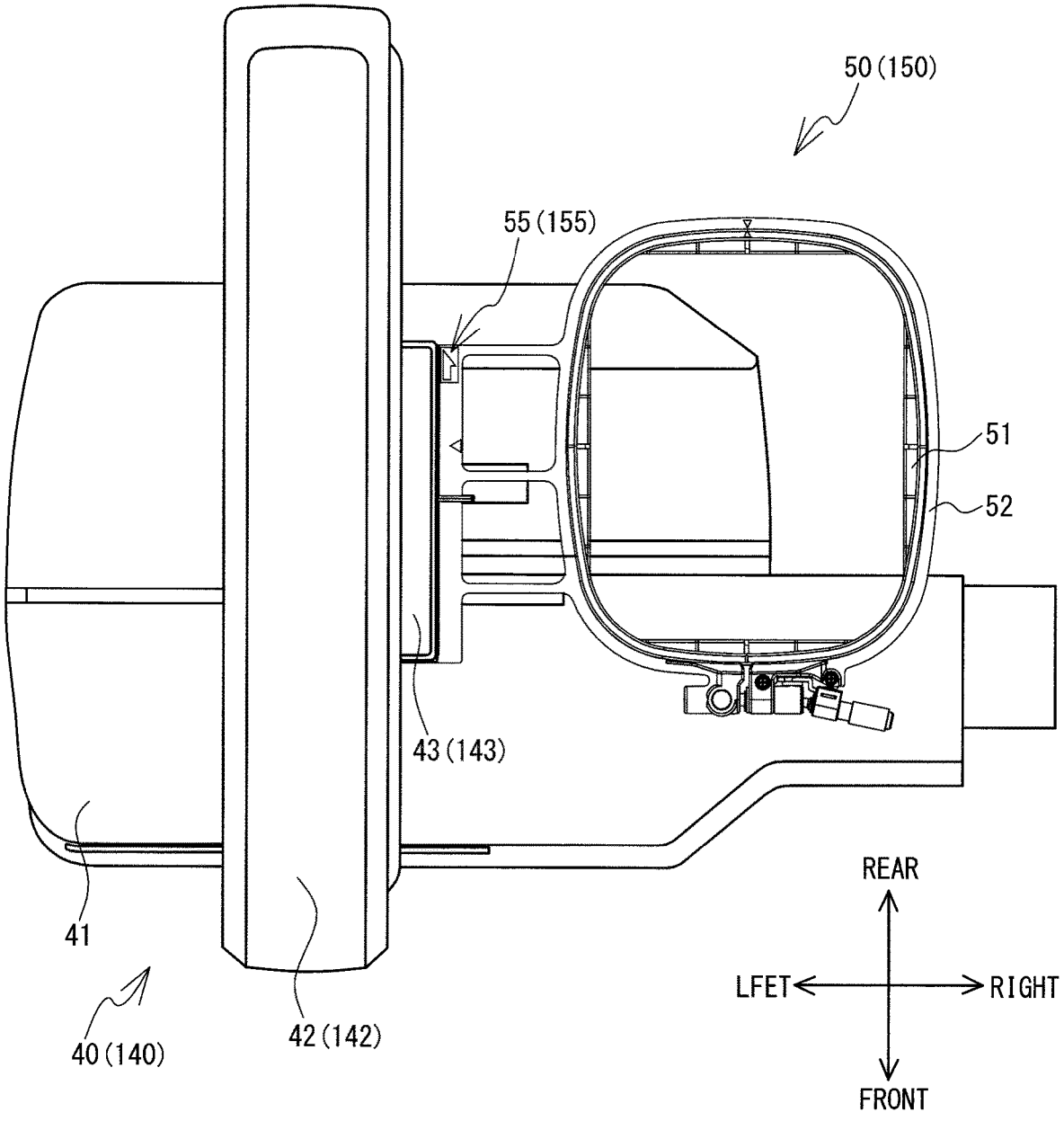
FIG. 2 is a plan view of the embroidery frame transport device on which an embroidery frame is mounted and arranged in an attaching position.

As shown in FIG. 1 and FIG. 2, the device 40 is configured to be removably mounted on the sewing machine 1. The device 40 is configured to relatively move a sewing object C, which is held by an embroidery frame 50, with respect to the needle bar 6. The device 40 is provided with a main body portion 41 and a carriage 42. The carriage 42 is provided with a holder 43, a Y axis movement mechanism (not shown in the drawings) and a Y axis motor (not shown in the drawings). The holder 43 is provided on the right side surface of the carriage 42. The embroidery frame 50 is configured to be mounted on and removed from the holder. The Y axis movement mechanism causes the holder 43 to move in the front-rear direction (a Y axis direction). The Y axis motor is configured to drive the Y axis movement mechanism. The holder 43 will be explained in detail later.

The main body portion 41 is internally provided with an X axis movement mechanism (not shown in the drawings) and an X axis motor (not shown in the drawings). The X axis movement mechanism causes the carriage 42 to move in the left-right direction (an X axis direction). The X axis motor is configured to drive the X axis movement mechanism. When embroidery sewing is performed using the embroidery frame 50, the device 40 is configured to move the embroidery frame 50 mounted on the frame holder of the carriage 42 to a position indicated by an XY coordinate system (an embroidery coordinate system) specific to the embroidery frame 50.

Figure 3A:
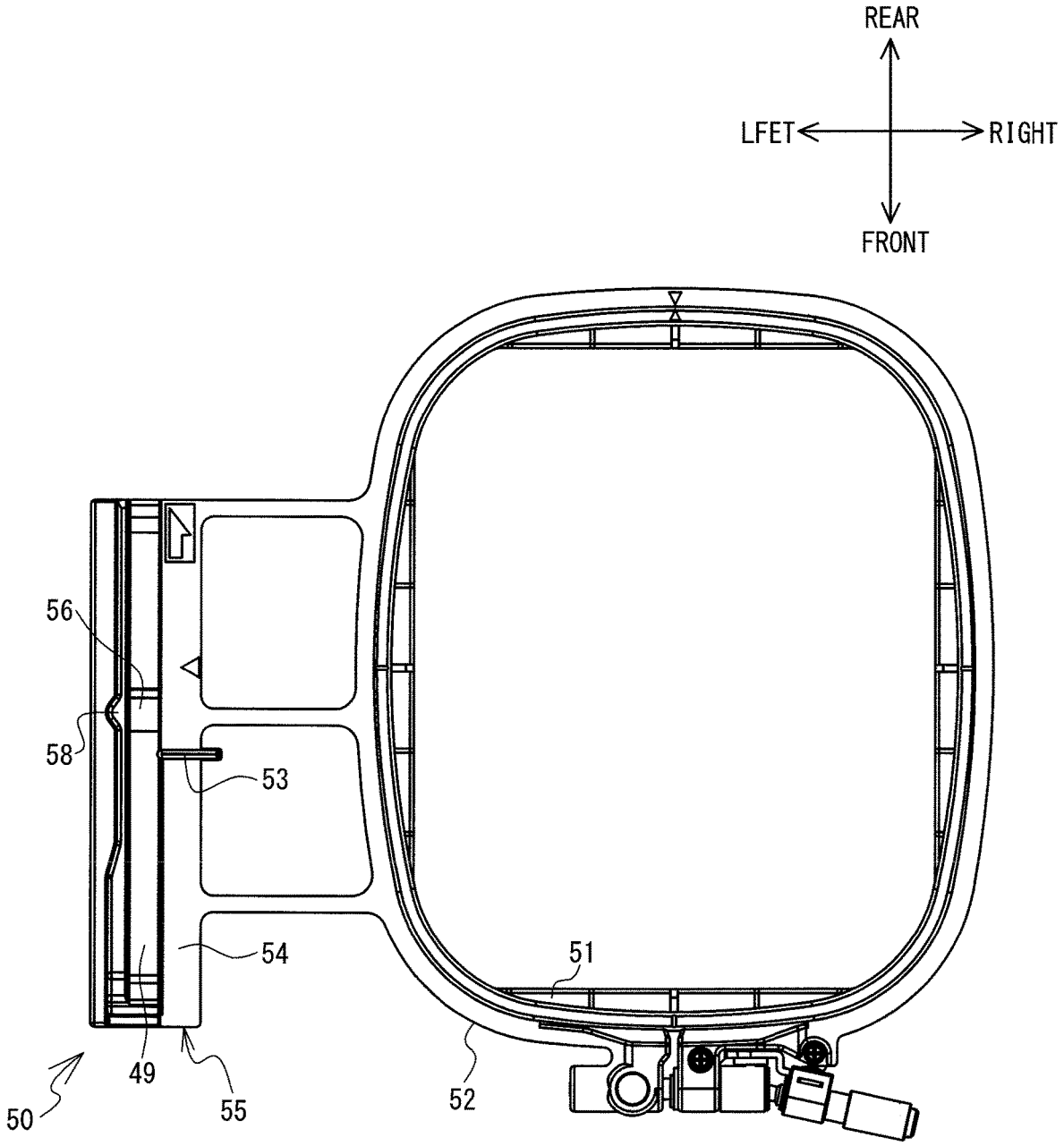
FIG. 3A is a plan view of the embroidery frame.
Figure 3B:
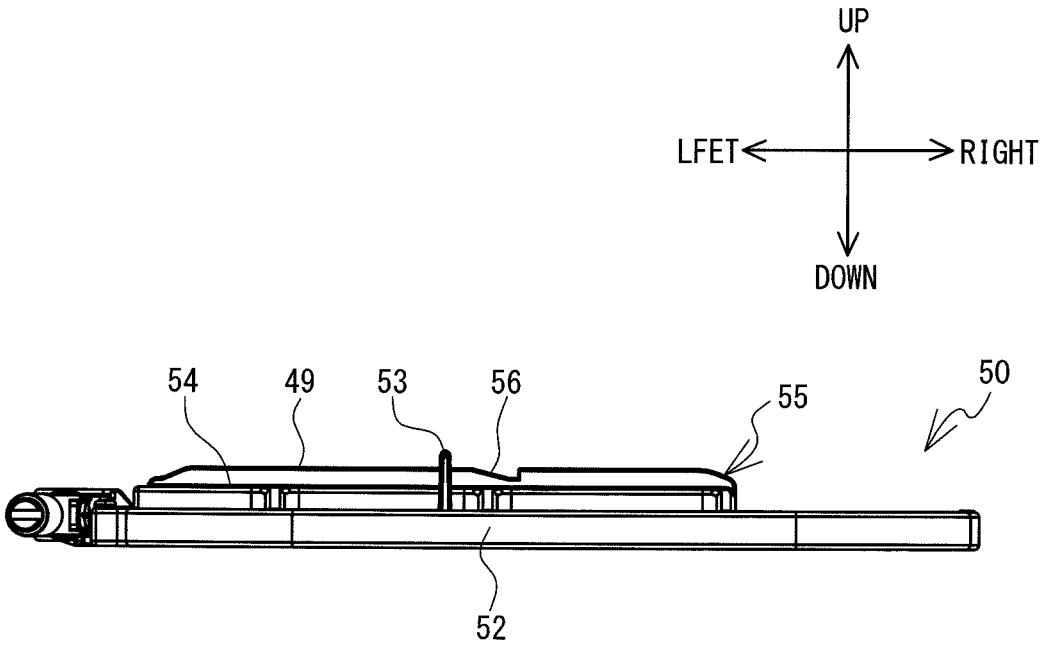
FIG. 3B is a right side view of the embroidery frame.
Figure 3C:
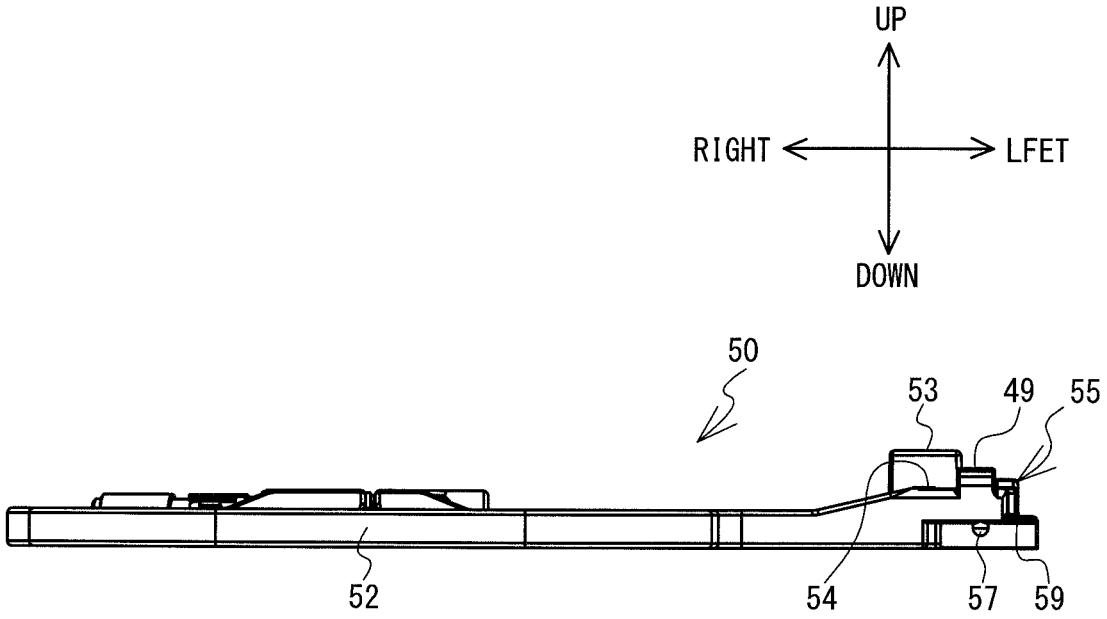
FIG. 3C is a back view of the embroidery frame.

The embroidery frame 50 according to a first embodiment will be described with reference to FIG. 3A to FIG. 3C. The embroidery frame 50 includes a first frame 51, a second frame 52, and a coupling portion 55, and is configured to hold the sewing object C (refer to FIG. 1) with the first frame 51 and the second frame 52. The coupling portion 55 is a portion that is to be mounted on the holder 43. The coupling portion 55 has a rectangular shape in a plan view that extends in the front-rear direction. The coupling portion 55 includes a contact portion 53, a recessed portion 56, a guide portion 57, and a protrusion 58. The contact portion 53 is a plate-shaped portion that is provided in substantially the center of a first surface 54 of the coupling portion 55 in the front-rear direction, and extends in a direction (upward) away from the first surface 54. The first surface 54 of the coupling portion 55 is a surface that is on the side facing a release member 60 (described later) of the device 40 when the embroidery frame 50 is attached to the device 40. The first surface 54 has a rectangular shape that is long in the front-rear direction. The recessed portion 56 is a recessed portion that is provided on a third surface 49 of the coupling portion 55 and is recessed in a direction (downward) toward a second surface 59 on the side opposite from the third surface 49. The third surface 49 is a surface that is arranged closer to the carriage 42 than the first surface 54, on the side facing the release member 60 of the device 40 when the embroidery frame 50 is attached to the device 40. The distance between the third surface 49 and the second surface 59 is longer than the distance between the first surface 54 and the second surface 59. The second surface 59 is a surface on the side opposite of the first surface 54 and the third surface 49 of the coupling portion 55. That is, the third surface 49 extends farther upward than the first surface 54.

The recessed portion 56 is positioned slightly to the rear of the center in the front-rear direction of the third surface 49. As shown in FIG. 3B, the recessed portion 56 has a V shape in a right side view. A rear portion of the recessed portion 56 extends substantially perpendicular to the third surface 49. A front portion of the recessed portion 56 inclines downward at an angle to the rear. As shown in FIG. 3C, the guide portion 57 is a protrusion that is provided on the second surface 59 and protrudes in a direction (downward) away from the second surface 59. The guide portion 57 extends in a straight line along the front-rear direction. The protrusion 58 is a protrusion that protrudes toward the left at a position unique to the embroidery frame 50, on the left side surface of the coupling portion 55. When the embroidery frame 50 is mounted on the holder 43 of the device 40, the sewing machine 1 can identify that the embroidery frame 50 has been attached as well as the type of embroidery frame 50, on the basis of the position of the protrusion 58 detected by a detector (not shown in the drawings).

Figure 4:
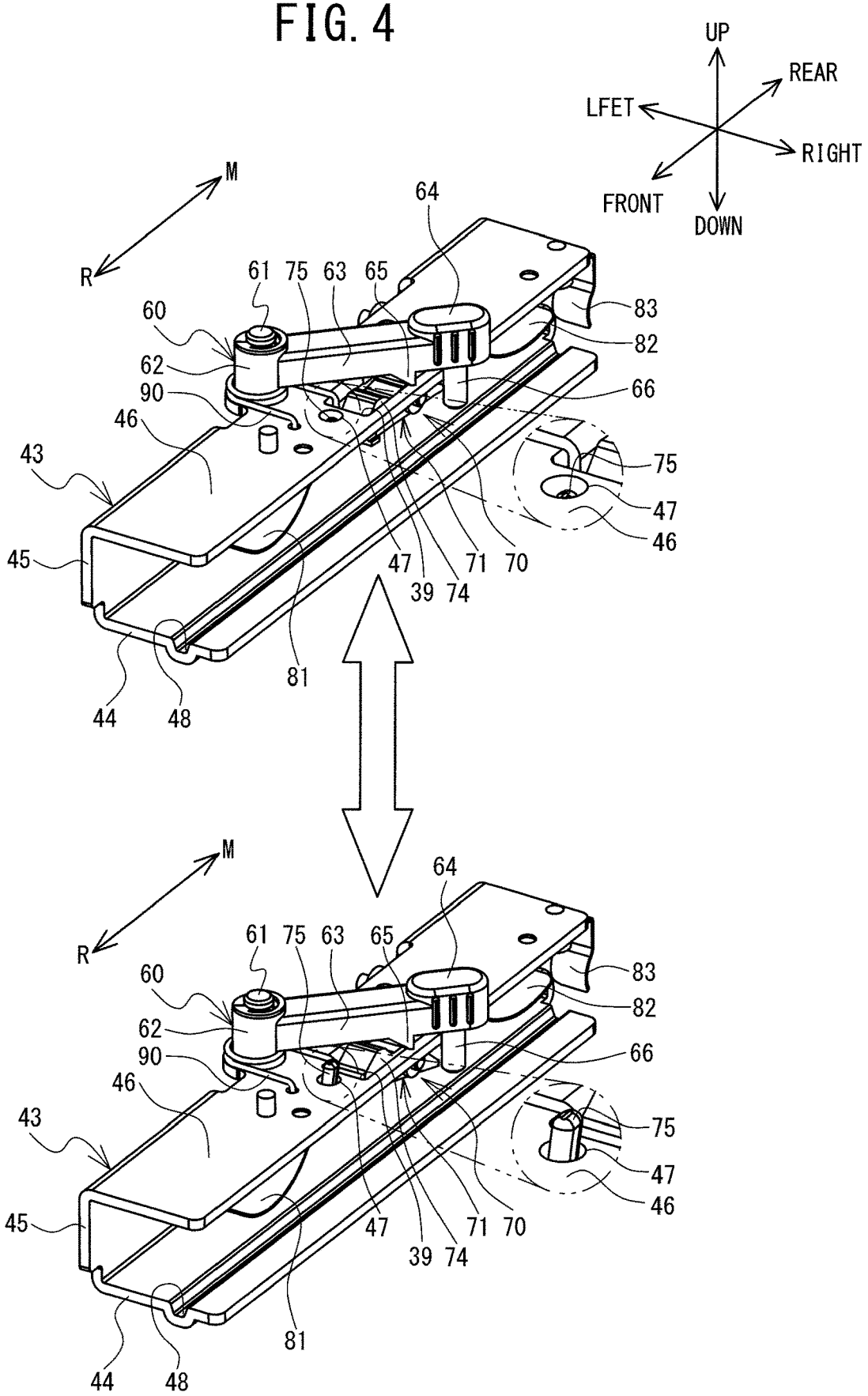
FIG. 4 is an explanatory view of the position of an indicator portion corresponding to the engagement situation of an engagement mechanism and a recessed portion of a coupling portion.

The holder 43 according to the first embodiment will be described with reference to FIG. 4 to FIG. 6. The holder 43 is a member having a rectangular shape that is long in the front-rear direction in a plan view. As shown in FIG. 4, the holder 43 has a C shape that opens to the right in a front view. The holder 43 has a first plate portion 44, a second plate portion 45, and a third plate portion 46. The first plate portion 44 is a flat plate-shaped portion facing the bed portion 11 of the sewing machine 1 when the device 40 is attached to the sewing machine 1. The first plate portion 44 forms a lower side portion of the C-shaped holder 43 in a front view. A guide groove 48 that extends parallel to the longitudinal direction of the holder 43 is provided in the first plate portion 44. The guide groove 48 contacts the guide portion 57 provided on the coupling portion 55 of the embroidery frame 50 to define a mounting direction M and a removing direction R of the embroidery frame 50. The mounting direction M and the removing direction R of the embroidery frame 50 in present embodiment match the longitudinal direction of the holder 43 and the coupling portion 55. The mounting direction M in present embodiment is the rearward direction. The removing direction R is the forward direction. The second plate portion 45 is a flat plate-shaped portion facing the carriage 42. The second plate portion 45 forms a left side portion of the C-shaped holder 43 in a front view. The third plate portion 46 is a flat plate-shaped portion facing the first plate portion 44. The third plate portion 46 forms an upper side portion of the C-shaped holder 43 in a front view. A hole 47 that is circular in a plan view, and a hole 39 that is rectangular in a plan view are provided in the third plate portion 46. The hole 47 and the hole 39 pass through the third plate portion 46 in a thickness direction. The hole 39 is provided farther to the rear than the hole 47, with the front-rear direction being the longitudinal direction.

As shown in FIG. 4, an engagement mechanism 70, the release member 60, and a second urging member 90 are provided on the holder 43. The engagement mechanism 70 is provided on the holder 43, and engages with the coupling portion 55 by moving the embroidery frame 50 in the mounting direction M to restrict the embroidery frame 50 from moving in the removing direction R, in a case where the coupling portion 55 is mounted on the holder 43.

Figure 5:
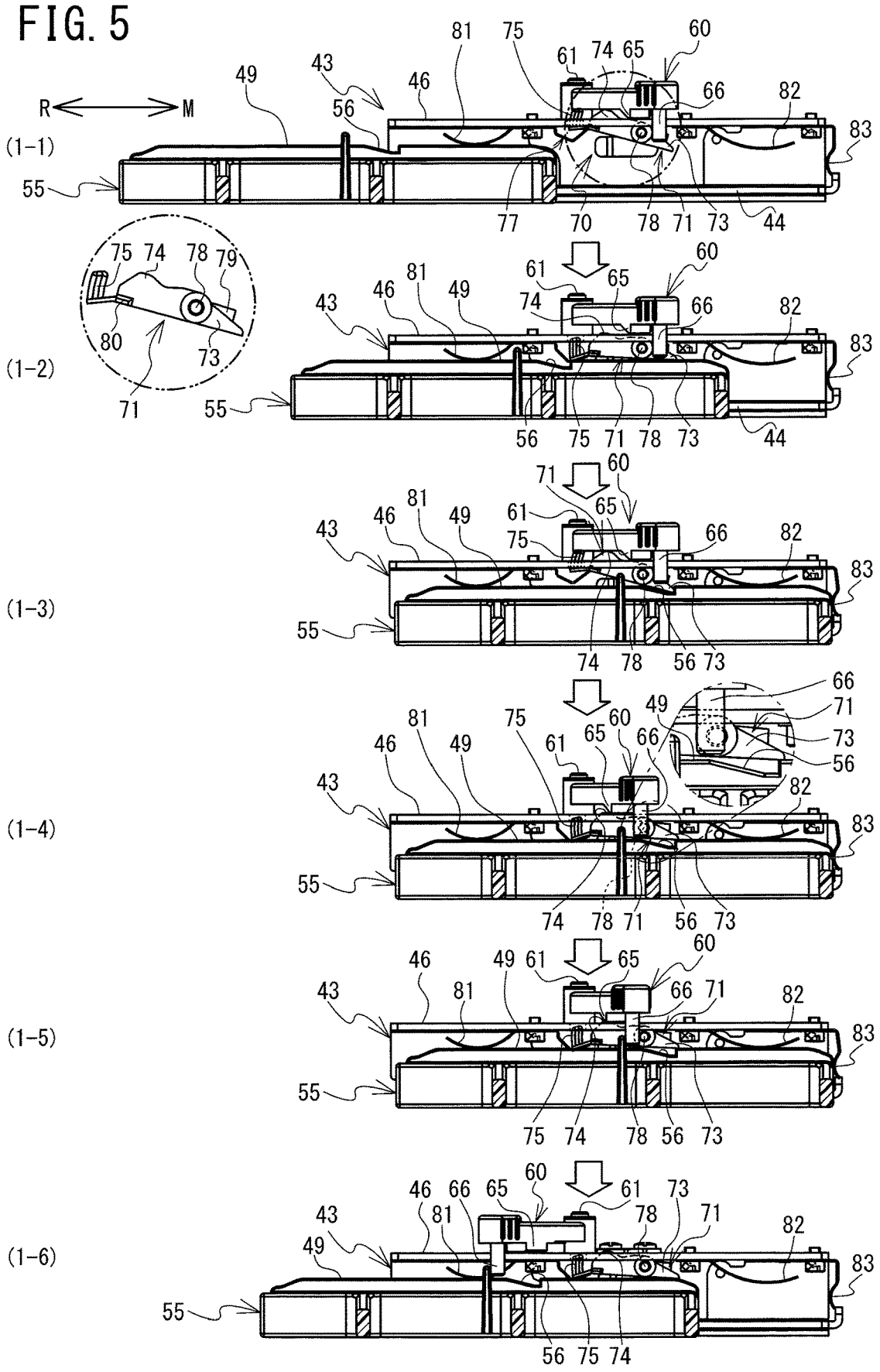
FIG. 5 is an explanatory view (right side view) of a process of attaching and detaching the coupling portion of the embroidery frame to and from a holder.

As shown in FIG. 5, the engagement mechanism 70 includes an engagement member 71 and a first urging member 77. The engagement member 71 is a rectangular-shaped member in a plan view, with the direction that is the same as the longitudinal direction (front-rear direction) of the carriage 42 (holder 43) being the longitudinal direction. The engagement member 71 is swingably supported on the third plate portion 46 of the holder 43 by a shaft 78 that extends in the left-right direction, on the side slightly to the rear of the center in the longitudinal direction of the engagement member 71. The engagement member 71 has an engagement portion 73, a contact portion 74, and an indicator portion 75. The engagement portion 73 is an acute triangular-shaped portion in a right side view that is provided on one end portion (rear end portion) of the engagement member 71. The engagement portion 73 is configured to engage with the recessed portion 56 provided on the coupling portion 55 of the embroidery frame 50 when the embroidery frame 50 is arranged at an attaching position (refer to FIG. 2) with respect to the holder 43. A protrusion 79 that extends in the front-rear direction is provided on a surface (upper surface) of the engagement portion 73 that is on the side facing the third plate portion 46. The protrusion 79 restricts over-rotation of the engagement member 71 in the counterclockwise direction in a right side view. A protrusion 80 that extends to the right is provided on the right side surface of the engagement portion 73. The protrusion 80 restricts over-rotation of the engagement member 71 in the clockwise direction in a right side view.

The contact portion 74 is a portion that becomes a protrusion on the upper side provided on the other end portion (front end portion) of the engagement member 71. The contact portion 74 is a portion that can contact the release member 60. The contact portion 74 is inserted through the hole 39 in the third plate portion 46 and contacts the release member 60 above the third plate portion 46 when the release member 60 is moved to a second position, described later, while the embroidery frame 50 is in a state arranged in the attaching position with respect to the holder 43. The first urging member 77 urges the engagement portion 73 of the engagement member 71 toward the coupling portion 55 of the embroidery frame 50. The first urging member 77 is a plate spring, one end (front end) of which is fixed to the holder 43. The other end portion (rear end portion) of the first urging member 77 urges the surface of the engagement member 71 that faces the first plate portion 44 in a direction from the first plate portion 44 toward the third plate portion 46 (clockwise in a right side view), on the side farther toward the front than the shaft 78. As a result, the engagement portion 73 is urged in a direction from the third plate portion 46 toward the first plate portion 44.

The indicator portion 75 indicates the engagement situation between the coupling portion 55 of the embroidery frame 50 and the engagement mechanism 70 (the engagement portion 73 of the engagement member 71). The indicator portion 75 is a protrusion that is provided on the front end portion of the engagement member 71 and protrudes upward. The indicator portion 75 indicates the engagement situation between the coupling portion 55 of the embroidery frame 50 and the engagement mechanism 70 (the engagement portion 73 of engagement member 71) by the position with respect to the third plate portion 46. More specifically, as shown on the upper side of FIG. 4, the coupling portion 55 of the embroidery frame 50 and the engagement mechanism 70 are not engaged with each other when the leading end (upper end) of the indicator portion 75 is in a position lower than the third plate portion 46, in a state in which the coupling portion 55 is arranged with respect to the holder 43. As shown on the lower side of FIG. 4, the coupling portion 55 of the embroidery frame 50 and the engagement mechanism 70 are engaged with each other when the leading end (upper end) of the indicator portion 75 is inserted through the hole 47 and in a position higher than the third plate portion 46, in a state in which the coupling portion 55 is arranged with respect to the holder 43.

The release member 60 is provided on the carriage 42 (holder 43), and is configured to release engagement between the engagement mechanism 70 and the coupling portion 55, as well as press the embroidery frame 50 in the removing direction R. The release member 60 is a lever member that is swingably supported by the carriage 42 (holder 43). The release member 60 is provided on the third plate portion 46 of the holder 43 in a manner configured to move to a first position, a second position, and a third position. The first position is a position in which the release member 60 is retracted from the engagement mechanism 70. The second position is a position in which the release member 60 contacts the engagement mechanism 70, thereby releasing engagement between the coupling portion 55 and the engagement mechanism 70. The third position is a position in which the release member 60 contacts the contact portion 53 of the coupling portion 55, in a state in which engagement between the engagement mechanism 70 and the coupling portion 55 has been released. The first position in the first embodiment is a position in which a pressing portion 66 that will be described later is within a range P11 in FIG. 6 in a plan view. The second position is a position in which the pressing portion 66 is within a range P12. The third position is a position in which the pressing portion 66 is within a range P13.

As shown in FIG. 4, the release member 60 includes a shaft 61, a base end portion 62, an arm portion 63, an operation portion 64, a cam portion 65, and the pressing portion 66. The shaft 61 is a cylindrically-shaped bar that extends upward from the third plate portion 46. The base end portion 62 is provided on one end side of the release member 60, and the shaft 61 is inserted through this base end portion 62. The release member 60 is configured to rotate around the shaft 61 to the first position, the second position, and the third position. The arm portion 63 is a plate-shaped portion that extends linearly from the base end portion 62. The operation portion 64 is a portion provided on the end portion of the release member 60 that is on the side opposite to the base end portion 62. A user rotates the release member 60 in the clockwise direction in a plan view by operating the operation portion 64, when the embroidery frame 50 mounted on the holder 43 is removed. The cam portion 65 can contact the contact portion 74 of the engagement member 71. The cam portion 65 is a protrusion that is provided on the surface of the arm portion 63 that is on the side facing the third plate portion 46, and protrudes toward the third plate portion 46 side (downward). The pressing portion 66 contacts the contact portion 53 of the coupling portion 55 and presses the embroidery frame 50 in the removing direction R while the release member 60 moves from the second position toward the third position (clockwise in a plan view), through the range P13 where the release member 60 is in the third position. The embroidery frame 50 moves together with the release member 60 in the removing direction R while the release member 60 moves through the range P13 where the release member 60 is in the third position.

In a case where the release member 60 is moved from the first position to the second position, the release member 60 contacts the contact portion 74 of the engagement mechanism 70, and moves the engagement portion 73 of the engagement member 71 in a direction away from the recessed portion 56 of the coupling portion 55 against the urging force of the first urging member 77. As a result, the release member 60 releases the engagement between the engagement portion 73 of the engagement member 71 and the recessed portion 56 of the coupling portion 55.

The second urging member 90 urges the release member 60 in a direction from the second position toward the first position (counterclockwise in a plan view). The second urging member 90 of present embodiment is a torsion spring through which the base end portion 62 of the release member 60 is inserted. The release member 60 is urged by the second urging member 90, so the release member 60 is positioned in the first position when the release member 60 is not operated by the user against the urging force of the second urging member 90.

As shown in FIG. 4, the holder 43 of present embodiment also includes urging members 81 to 83. The urging members 81 and 82 are plate springs that extend substantially parallel to the guide groove 48. The urging member 81 has a shape curved so as to protrude on the first plate portion 44 side, and is fixed at one end (the rear end) to the side slightly in front of the center of the third plate portion 46 of the holder 43 in the front-rear direction. The urging member 82 has a shape curved so as to protrude on the first plate portion 44 side, and is attached at one end (the front end) to the side slightly to the rear of the center of the lower surface of the third plate portion 46 of the holder 43 in the front-rear direction. The protrusion amount toward the first plate portion 44 side is larger with the urging member 82 than with the urging member 81. The other end (the front end) of the urging member 81 and the other end (the rear end) of the urging member 82 are free ends, and have curved shapes so as not to hit the rear end portion of the coupling portion 55 when the coupling portion 55 is mounted on the holder 43. The urging members 81 and 82 are separated from the first plate portion 44. When the coupling portion 55 is attached to the holder 43, the coupling portion 55 is arranged between the urging members 81 and 82, and the first plate portion 44. The pressing force from above of the urging members 81 and 82 does not interfere with the movement of the coupling portion 55, and suppresses looseness in the up-down direction when attaching and detaching the coupling portion 55. The urging member 83 is a plate spring that extends toward the first plate portion 44 side from the rear end of the third plate portion 46. The urging member 83 urges the coupling portion 55 that is arranged in the attaching position in the removing direction R.

The operation of attaching and detaching the embroidery frame 50 to and from the holder 43 of the first embodiment will be described with reference to FIG. 5 and FIG. 6. As shown in state (1-1) of FIG. 5, when the embroidery frame 50 is mounted on the holder 43, the user inserts the rear end of the coupling portion 55 from the front end of the holder 43, and moves the coupling portion 55 in the mounting direction M while the guide portion 57 of the coupling portion 55 is engaged with the guide groove 48 of the holder 43. The urging member 81 provided on the holder 43 contacts the third surface 49 of the coupling portion 55 and is configured to urge the coupling portion 55 to the side (downward) toward the first plate portion 44 from the third plate portion 46. In state (1-1), the leading end of the indicator portion 75 is inserted through the hole 47 in the third plate portion 46, and is positioned higher than the third plate portion 46.

As shown in state (1-2), when the user moves the coupling portion 55 farther in the mounting direction M, the rear end portion of the coupling portion 55 contacts the rear end portion of the engagement member 71 and rotates the engagement member 71 in the counterclockwise direction in a right side view. With this rotation of the engagement member 71, the engagement portion 73 that is on the rear end of the engagement member 71 moves upward and contacts the third surface 49 of the coupling portion 55. When the user moves the coupling portion 55 farther to the rear, the urging member 82 provided on the holder 43 contacts the third surface 49 of the coupling portion 55 and is configured to urge the coupling portion 55 to the side (downward) toward the first plate portion 44 from the third plate portion 46. In state (1-2), the leading end of the indicator portion 75 is positioned lower than the third plate portion 46.

As shown in state (1-3), when the user moves the coupling portion 55 farther in the mounting direction M such that the coupling portion 55 is arranged in the attaching position, the rear end of the coupling portion 55 comes into contact with the urging member 83. The coupling portion 55 receives force in the removing direction R from the urging member 83. The engagement portion 73 of the engagement member 71 moves downward and engages with the recessed portion 56 of the coupling portion 55. The coupling portion 55 is restricted from moving in the mounting direction M and the removing direction R by the engagement portion 73 and the urging member 83. The coupling portion 55 is restricted from moving in the up-down direction by the first plate portion 44 and the urging members 81 and 82. In state (1-3), the leading end of the indicator portion 75 is inserted through the hole 47 in the third plate portion 46, and is positioned higher than the upper surface of the third plate portion 46.

Figure 6:
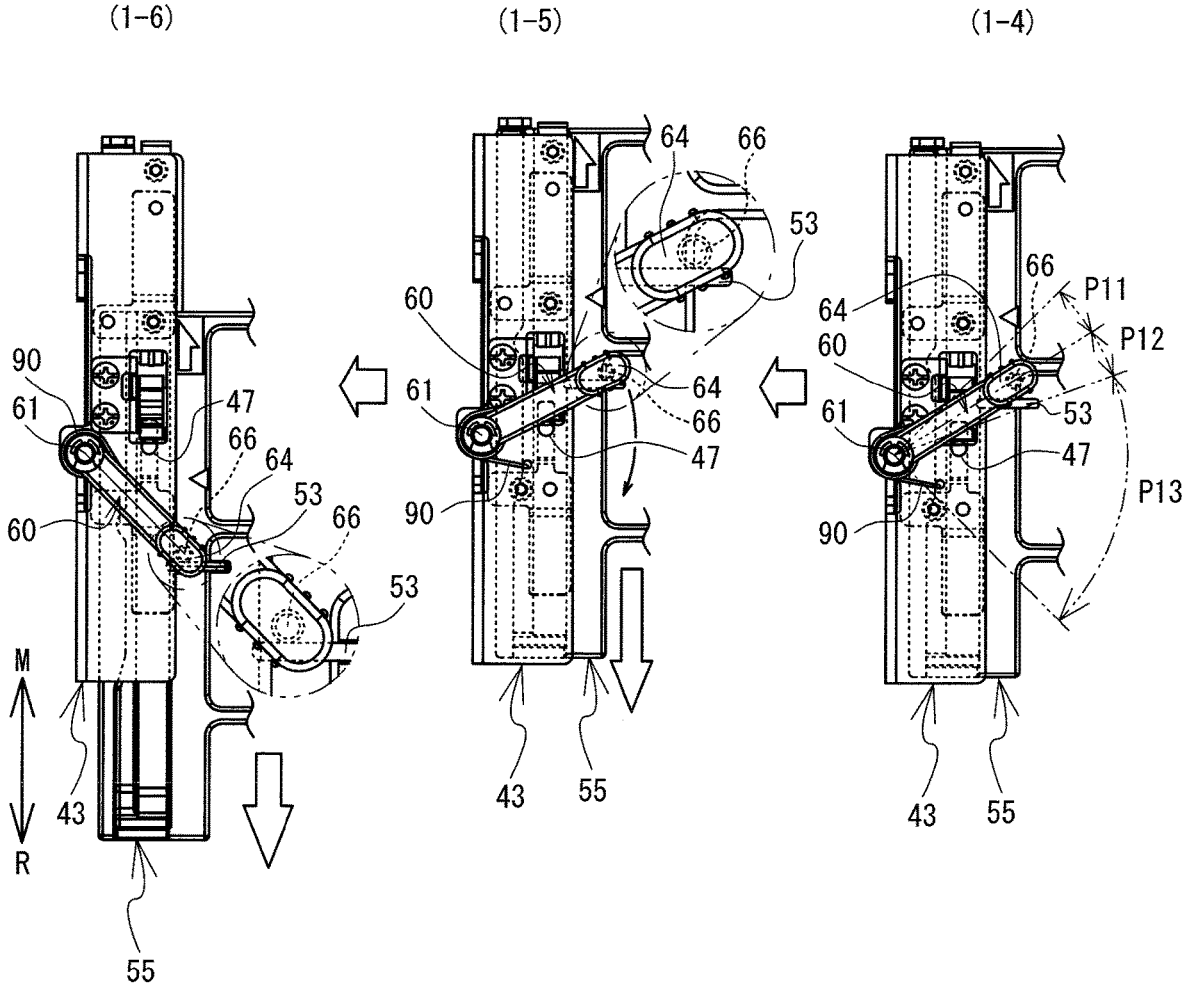
FIG. 6 is an explanatory view (right side view) of a process of removing the coupling portion of the embroidery frame from the holder.

As shown in FIG. 5 and FIG. 6, when the embroidery frame 50 is removed from the holder 43, the user rotates the release member 60 clockwise in a plan view from the first position, around the shaft 61. As shown in state (1-4), when the user moves the release member 60 to the second position, the cam portion 65 of the release member 60 contacts the contact portion 74 of the engagement member 71 and rotates the engagement member 71 in the counterclockwise direction in a right side view. As a result, the engagement portion 73 of the engagement member 71 moves toward the third plate portion 46 of the holder 43 (upward), such that the engagement between the engagement portion 73 and the recessed portion 56 of the coupling portion 55 is released. At this time, the pressing portion 66 of the release member 60 and the contact portion 53 of the coupling portion 55 are not contacting each other.

When the user rotates the release member 60 farther in the clockwise direction in a plan view, the contact portion 74 continues to contact the release member 60, while being guided by the cam portion 65. The engagement portion 73 of the engagement member 71 maintains the state in which engagement with the recessed portion 56 of the coupling portion 55 is released. As shown in state (1-5), when the release member 60 is moved to the third position, the pressing portion 66 of the release member 60 comes into contact with the contact portion 53 of the coupling portion 55. When the release member 60 is moved clockwise in a plan view within the range P13 where the release member 60 is in the third position, the contact portion 53 of the coupling portion 55 receives force toward the removing direction R from the pressing portion 66 of the release member 60, such that the coupling portion 55 moves in the removing direction R. The engagement portion 73 of the engagement member 71 comes into contact with the third surface 49 of the coupling portion 55. As shown in state (1-6), the operation portion 64 of the release member 60 is rotated in the clockwise direction in a plan view, and comes into contact with the holder 43 farther in the removing direction R than the shaft 61. When the user stops operating the release member 60, the release member 60 rotates counterclockwise in a plan view by the urging force of the second urging member 90, and returns to the first position (more specifically, the position in which the pressing portion 66 contacts the holder 43 farther to the rear than the shaft 61). The embroidery frame 50 is in a state moved farther in the removing direction R than the attaching position shown in state (1-3). The engagement between the engagement mechanism 70 and the coupling portion 55 is released and the coupling portion 55 is separated from the urging member 82, so the user can move the coupling portion 55 in the removing direction R with comparatively little force, and remove the embroidery frame 50 from the holder 43. From state (1-4) to state (1-6), the leading end of the indicator portion 75 is positioned lower than the upper surface of the third plate portion 46.

An embroidery frame transport device (hereinafter, simply referred to as "device") 140 and an embroidery frame 150 of a second embodiment will now be described. The device 40 of the first embodiment differs from the device 140 of the second embodiment with regards to a holder 143 provided on a carriage 142, and a second urging member 190 and a release member 160 provided on the holder 143; the other configuration is the same. The embroidery frame 50 of the first embodiment differs from the embroidery frame 150 of the second embodiment with regards to a contact portion 153 of a coupling portion 155; the other configuration is the same. Therefore, components that are the same as the components of the first embodiment will be denoted by the same reference numerals, and detailed descriptions of these components will be omitted.

Figure 7A:
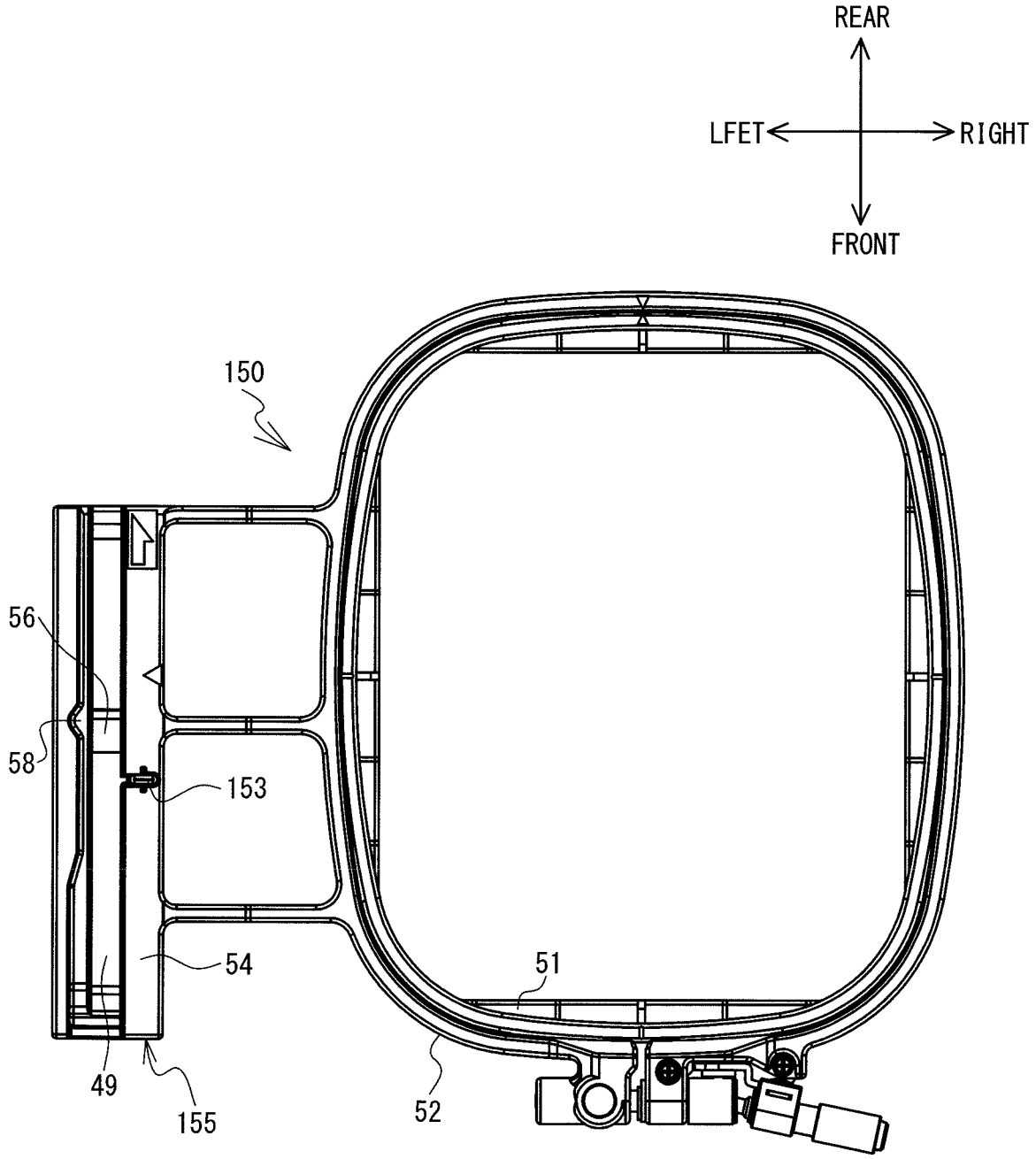
FIG. 7A is a plan view of an embroidery frame.
Figure 7B:
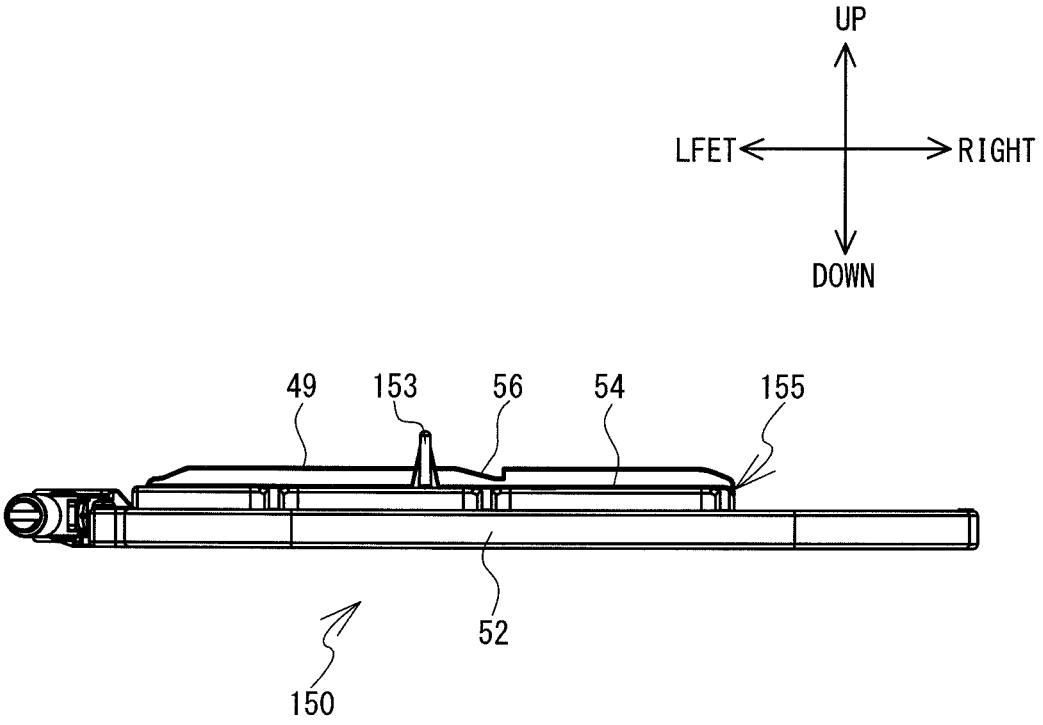
FIG. 7B is a right side view of the embroidery frame.
Figure 7C:
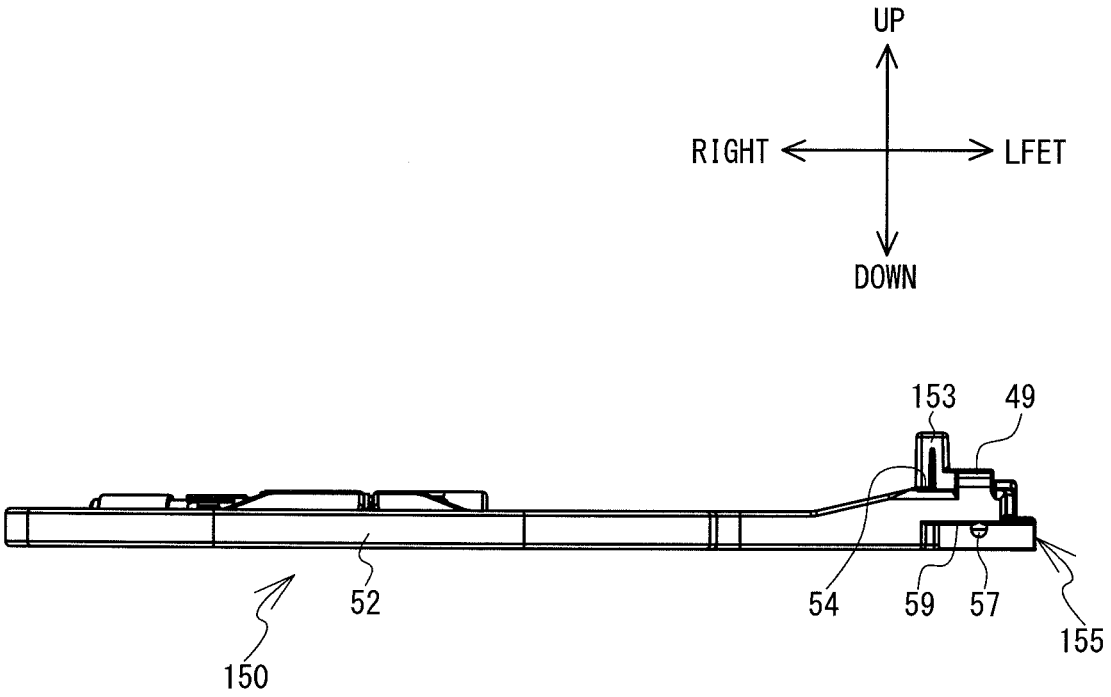
FIG. 7C is a back view of the embroidery frame.

As shown in FIG. 7A to 7C, the embroidery frame 150 of the second embodiment has the first frame 51, the second frame 52, and the coupling portion 155. The coupling portion 155 is a portion that is to be mounted on the holder 143. The coupling portion 155 has a rectangular shape in a plan view that extends in the front-rear direction of the embroidery frame 150. The coupling portion 155 includes the contact portion 153, the recessed portion 56, the guide portion 57, and the protrusion 58. The contact portion 153 is a plate-shaped portion that is provided in substantially the center of the first surface 54 of the coupling portion 155 in the mounting direction, and extends in a direction away from the first surface 54. The contact portion 153 of the second embodiment is longer in the up-down direction than the contact portion 53 of the embroidery frame 50 of the first embodiment.

Figure 8A:
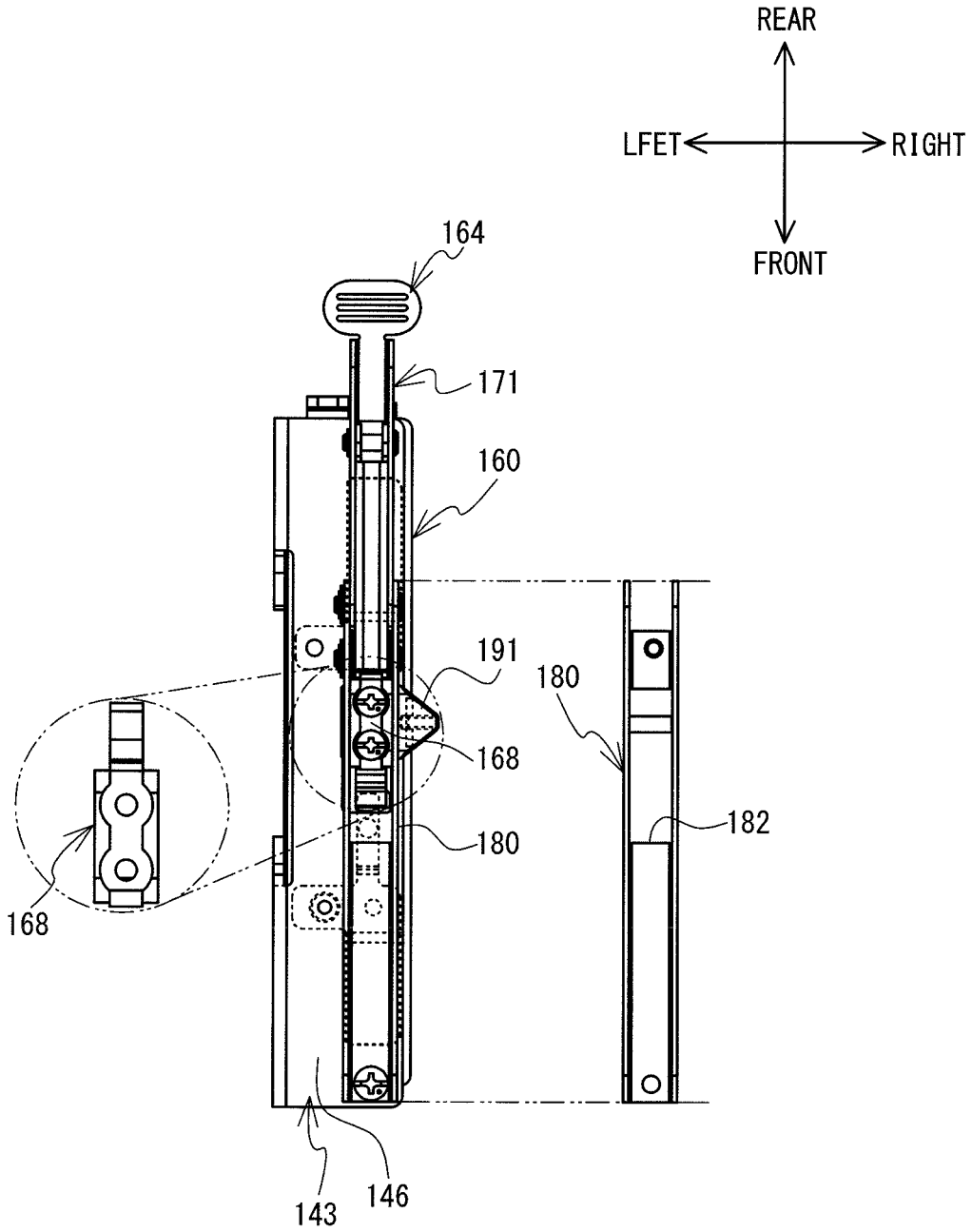
FIG. 8A is a plan view of a holder and a release member.
Figure 8B:
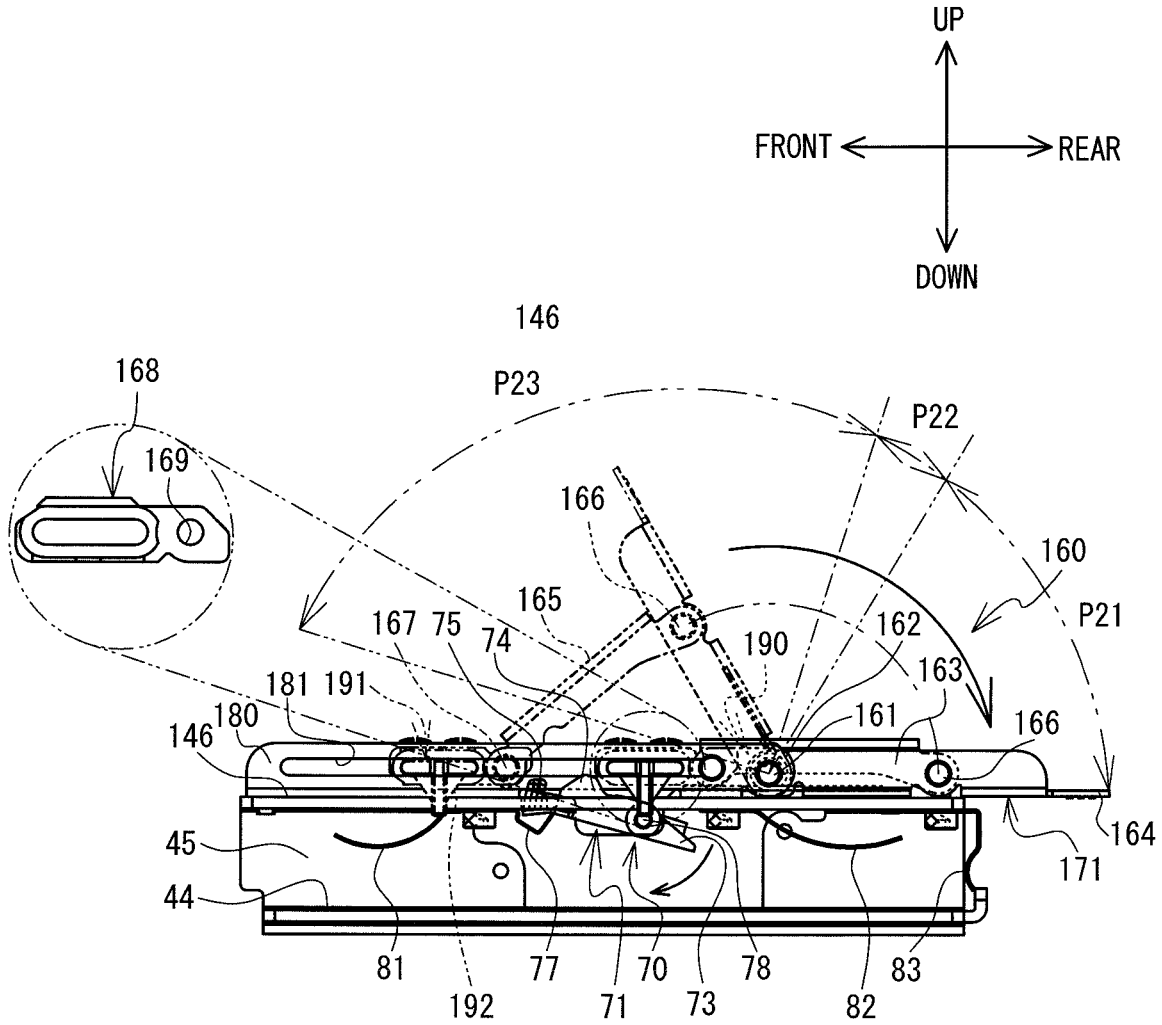
FIG. 8B is a right side view of the holder, an engagement mechanism, and the release member.

The holder 143 of the second embodiment will be described. As shown in FIGS. 8A and 8B, the holder 143 is a member having a rectangular shape that is long in the front-rear direction in a plan view. The holder 143 is a plate-shaped member having a C shape that opens to the right in a front view, similar to the holder 43 of the first embodiment. The holder 143 has the first plate portion 44, the second plate portion 45, and a third plate portion 146. The third plate portion 146 is a flat plate-shaped portion facing the first plate portion 44. The third plate portion 146 forms an upper side portion of the C-shaped holder 143 in a front view. Although not shown in the drawings, the third plate portion 146 has the hole 47 and the hole 39, similar to the first embodiment.

The engagement mechanism 70, the release member 160, and the second urging member 190 are provided on the holder 143. The engagement mechanism 70 is similar to the engagement mechanism 70 of the first embodiment. The release member 160 is provided on the holder 143, and can release engagement between the engagement mechanism 70 and the coupling portion 155, as well as press the embroidery frame 150 in the removing direction R. The release member 160 includes a lever member 171, a link member 165, a cam member 168, a guide rail 180, and a slider 191. The lever member 171 includes a base end portion 162, an arm portion 163, and an operation portion 164. The lever member 171 is swingably supported on the holder 143 by a shaft 161 that extends in the left-right direction. The arm portion 163 is a bar-shaped portion that extends from the base end portion 162 through which the shaft 161 is inserted. The operation portion 164 is provided on the end portion on the side of the arm portion 163 opposite of the base end portion 162. One end portion of the link member 165 is coupled to the lever member 171 at a portion midway between the shaft 161 of the arm portion 163 and the operation portion 164, by a link shaft 166 being inserted through the one end portion of the link member 165.

A hole that penetrates through in the left-right direction is provided in the other end portion of the link member 165. The cam member 168 is a member that extends in the front-rear direction in a plan view. The cam member 168 can contact the contact portion 74 of the engagement member 71. The cam member 168 has a hole 169 in the rear end portion, which that penetrates through in the left-right direction. A link shaft 167 is inserted through the hole provided in the other end portion of the link member 165 and the hole 169 in the cam member 168. The guide rail 180 has a U shape in a front view. The guide rail 180 is provided extending along the longitudinal direction of the holder 143, and a bottom surface of the guide rail 180 is fixed to the third plate portion 146. A rectangular hole 182 in a plan view that penetrates through in the up-down direction is provided in a position corresponding to the hole 39 and the hole 47 in the third plate portion 146, in the bottom surface of the guide rail 180. The left and right side surfaces of the guide rail 180 each have a long hole 181 that penetrates through in the left-right direction. The long holes 181 extend along the longitudinal direction of the holder 143 in a position higher than the third plate portion 146. The link shaft 167 is inserted through the long holes 181. The slider 191 is a member having a triangular shape in a plan view. The slider 191 is inserted through the long holes 181 and coupled to the right end portion of the cam member 168. The slider 191 has a protruding portion 192 that extends downward on a lower surface, and is T-shaped in a right side view. The lower surface of the slider 191 and the bottom surface of the guide rail 180 are separated from each other. The slider 191 comes into contact with the contact portion 153 of the coupling portion 155 and presses the embroidery frame 150 in the removing direction R while the release member 160 moves from a second position toward a third position, through a range P23 where the release member 160 is in the third position that will be described later.

The release member 160 is provided on the third plate portion 146 of the holder 143 in a manner configured to move to a first position, the second position, and the third position. The first position is a position in which the release member 160 is retracted from the engagement mechanism 70. The second position is a position in which the release member 160 contacts the engagement mechanism 70, thereby releasing engagement between the coupling portion 155 and the engagement mechanism 70. The third position is a position in which the release member 160 contacts the contact portion 153 of the coupling portion 155, in a state in which engagement between the engagement mechanism 70 and the coupling portion 155 has been released. The first position in the second embodiment is a position in which the lever member 171 is within a range P21 in FIG. 8B in a right side view. The second position is a position in which the lever member 171 is within a range P22. The third position is a position in which the lever member 171 is within the range P23.

The second urging member 190 urges the lever member 171 of the release member 160 in a direction from the second position toward the first position (clockwise in a right side view). The second urging member 190 of present embodiment is a torsion spring through which the shaft 161 is inserted. The release member 160 is urged by the second urging member 190, so the release member 160 is positioned in the first position when not being operated by the user against the urging force of the second urging member 190.

Figure 9:
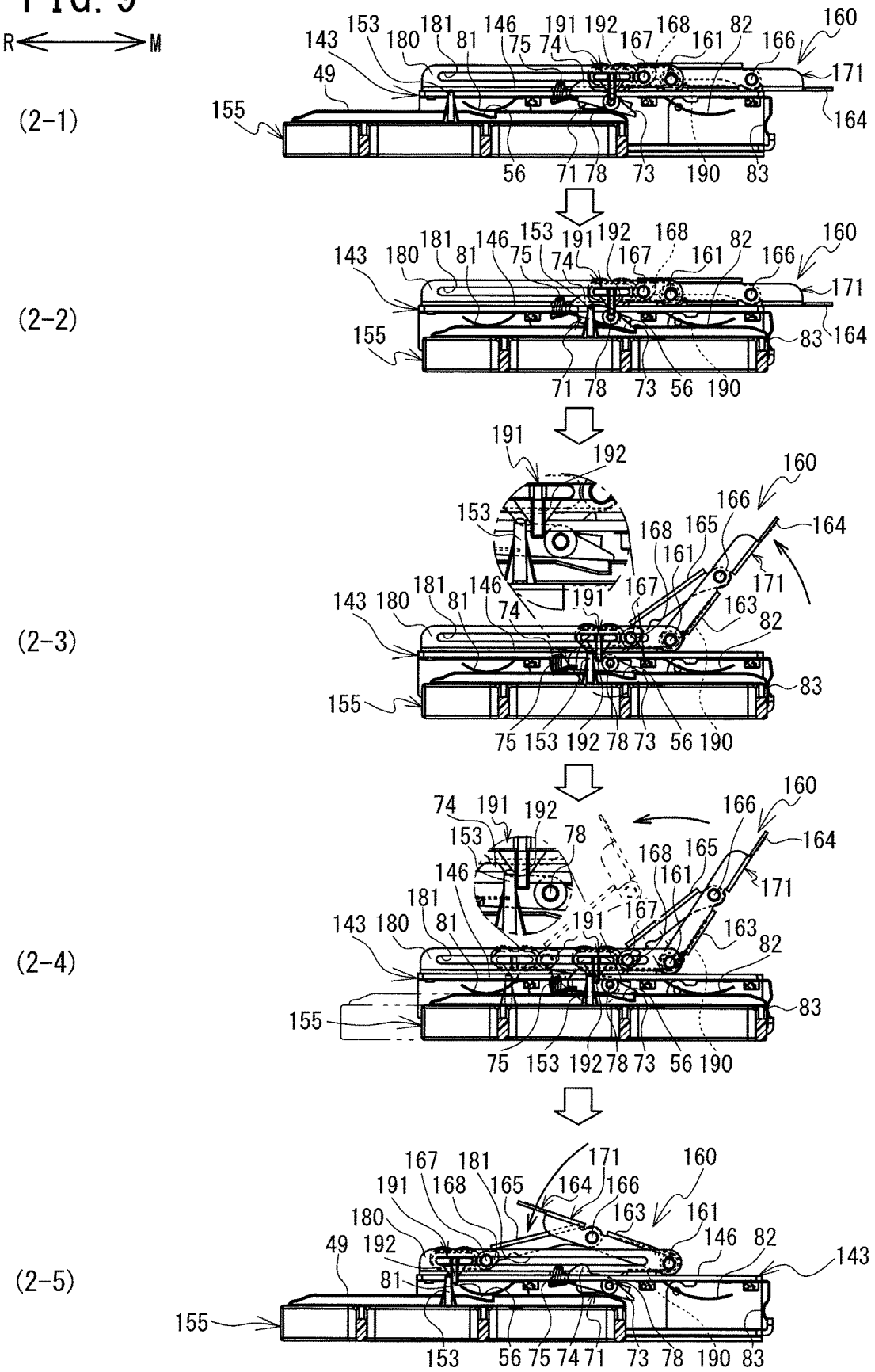
FIG. 9 is an explanatory view (right side view) of a process of attaching and detaching a coupling portion of the embroidery frame to and from the holder.
Figure 10:
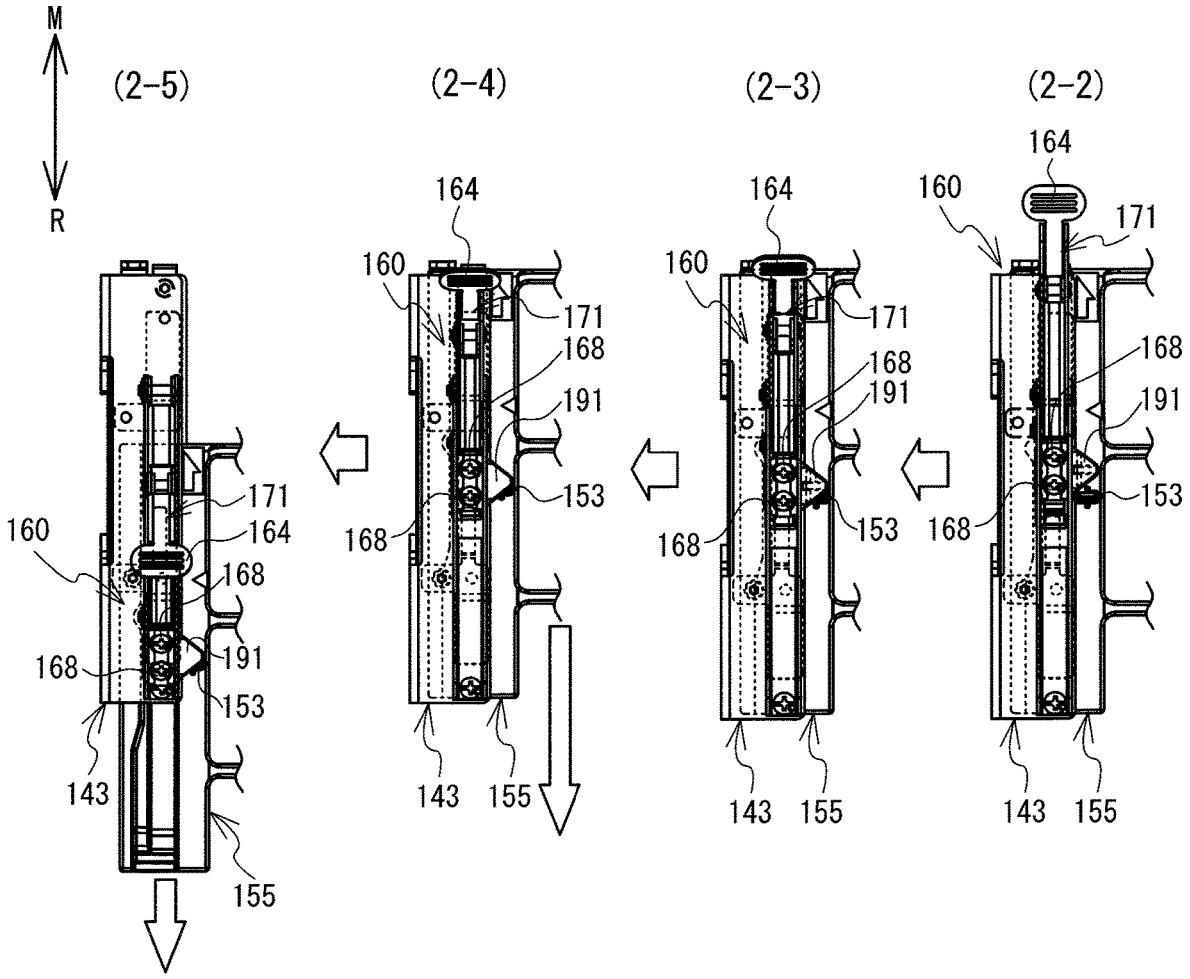
FIG. 10 is an explanatory view (right side view) of a process of removing the coupling portion of the embroidery frame from the holder.

The operation of attaching and detaching the embroidery frame 150 to and from the holder 143 of the second embodiment will be described with reference to FIG. 9 and FIG. 10. As shown in state (2-1) of FIG. 9, when the embroidery frame 150 is mounted on the holder 143, the user inserts the rear end of the coupling portion 155 from the front end of the holder 143, and moves the coupling portion 155 in the mounting direction M while the guide portion 57 of the coupling portion 155 is engaged with the guide groove 48 of the holder 143. The urging member 81 provided on the holder 143 contacts the third surface 49 of the coupling portion 155 and urges the coupling portion 155 to the side (downward) toward the first plate portion 44 from the third plate portion 146. When the user moves the coupling portion 155 farther in the mounting direction M, the rear end portion of the coupling portion 155 rotates the engagement member 71 in the counterclockwise direction in a right side view. With this rotation of the engagement member 71, the engagement portion 73 that is on the rear end of the engagement member 71 moves upward and contacts the third surface 49 of the coupling portion 155. When the user moves the coupling portion 155 farther in the mounting direction M, the urging member 82 provided on the holder 143 contacts the third surface 49 of the coupling portion 155 and urges the coupling portion 155 to the side (downward) toward the first plate portion 44 from the third plate portion 146.

As shown in state (2-2), when the user moves the coupling portion 155 farther in the mounting direction M such that the coupling portion 155 is arranged in the attaching position, the rear end of the coupling portion 155 comes into contact with the urging member 83. The coupling portion 155 receives force in the removing direction R from the urging member 83. The engagement portion 73 of the engagement member 71 engages with the recessed portion 56 of the coupling portion 155. The coupling portion 155 is restricted from moving in the mounting direction M and the removing direction R by the engagement portion 73 and the urging member 83. The coupling portion 155 is restricted from moving in the up-down direction by the first plate portion 44 and the urging members 81 and 82.

When the user removes the embroidery frame 150 from the holder 143, the user rotates the lever member 171 of the release member 160 counterclockwise in a right side view from the first position, around the shaft 161. As shown in state (2-3), when the user moves the release member 160 (lever member 171) to the second position, the lower surface of the cam member 168 of the release member 160 contacts the contact portion 74 of the engagement member 71 and rotates the engagement member 71 in the counterclockwise direction in a right side view. As a result, the engagement portion 73 of the engagement member 71 moves toward the third plate portion 146 of the holder 143 (upward), such that the engagement between the engagement portion 73 and the recessed portion 56 of the coupling portion 155 is released. At this time, the slider 191 of the release member 160 and the contact portion 153 of the coupling portion 155 are not contacting each other.

When the user rotates the lever member 171 of the release member 160 farther in the counterclockwise direction in a right side view, the contact portion 74 continues to contact the cam member 168 of the release member 160, while being guided by the cam member 168. The engagement portion 73 of the engagement member 71 maintains the state in which engagement with the recessed portion 56 of the coupling portion 155 is released. As shown in state (2-4), when the release member 160 (lever member 171) is moved to the third position, the slider 191 of the release member 160 comes into contact with the contact portion 153 of the coupling portion 155. As shown in state (2-5), when the release member 160 (lever member 171) is moved farther counterclockwise in a right side view from the third position, the contact portion 153 of the coupling portion 155 receives force from the slider 191 of the release member 160 toward the removing direction R, such that the coupling portion 155 moves in the removing direction R. The engagement portion 73 of the engagement member 71 comes into contact with the third surface 49 of the coupling portion 155. The operation portion 164 of the release member 160 is rotated in the counterclockwise direction in a right side view, and the slider 191 that is inserted through the long hole 181 comes into contact with the front end portion of the long hole 181 farther in the removing direction R than the shaft 161. When the user stops operating the release member 160, the release member 160 rotates clockwise in a right side view by the urging force of the second urging member 190, and returns to the first position. The embroidery frame 150 is in a state moved farther in the removing direction R than the attaching position shown in state (2-2). The engagement between the engagement mechanism 70 and the coupling portion 155 is released and the coupling portion 155 is separated from the urging member 82, so the user can move the coupling portion 155 in the removing direction with comparatively little force, and remove the embroidery frame 150 from the holder 143.

According to the device 40 (140), the release member 60 (160) can both release the engagement between the engagement mechanism 70 and the coupling portion 55 (155) of the embroidery frame 50 (150), and push the embroidery frame 50 (150) in the removing direction that is opposite the mounting direction, by the user operating the release member 60 (160). In other words, the device 40 (140) can simplify the operation of removing the embroidery frame 50 (150) from the device 40 (140), compared to a device of known art.

The release member 60 (160) is attached to the holder 43 (143) in a manner configured to move to the first position, the second position, and the third position. According to the device 40 (140), the user can remove the embroidery frame 50 (150) from the device 40 (140) by the simple operation of moving the release member 60 (160) from the first position to the third position through the second position. The device 40 (140) is such that the release member 60 (160) moves the embroidery frame 50 (150) in the removing direction R after the engagement between the engagement member 71 and the coupling portion 55 (155) is released, in the process of moving the release member 60 (160) from the first position to the third position. Therefore, the device 40 (140) can smoothly move the embroidery frame 50 (150) in the removing direction R while the engagement between the engagement member 71 and the coupling portion 55 (155) is reliably released.

The engagement mechanism 70 includes the engagement member 71 and the first urging member 77. According to the device 40 (140), the configuration of the engagement mechanism 70 can be relatively simple with the engagement member 71 and the first urging member 77. In a case where moved from the first position to the second position, the release member 60 (160) contacts the contact portion 74 of the engagement mechanism 70, and moves the engagement portion 73 in a direction away from the recessed portion 56 of the coupling portion 55 (155) against the urging force of the first urging member 77, thereby releasing the engagement between the engagement portion 73 and the recessed portion 56. According to the device 40 (140), the release member 60 (160) can release the engagement between the engagement portion 73 and the recessed portion 56 by a simple operation.

The release member 60 is a lever member that is swingably supported by the holder 43. The release member 60 includes the cam portion 65 and the pressing portion 66. The release member 160 includes the lever member 171 that is swingably supported by the holder 143. The release member 160 includes the cam member 168 and the slider 191. According to the device 40 (140), the configuration of the release member 60 (160) can be relatively simple. While the release member 60 (160) moves in the range where the release member 60 (160) is in the third position, the pressing portion presses the coupling portion 55 (155) of the embroidery frame 50 (150) in the removing direction, so the embroidery frame 50 (150) can be pulled out of the attaching position. The operation to move the release member 60 (160) from the first position to the third position is a simple operation that involves moving the operation portion 64 (164) of the release member 60 (160) from the rear side to the front side of the device 40 (140).

The device 40 (140) includes the second urging member 90 (190) that urges the release member 60 (160) in the direction from the second position toward the first position. According to the device 40 (140), the release member 60 (160) can be positioned in the first position when the release member 60 (160) is not being operated. The user does not need to move the release member 60 (160) that has been moved to the third position, to the first position.

The engagement mechanism 70 includes the indicator portion 75 that indicates the engagement situation between the engagement mechanism 70 and the coupling portion 55 (155). According to the device 40 (140), the user can confirm the engagement situation between the coupling portion 55 (155) and the engagement mechanism 70 with the indicator portion 75. The user can confirm whether the engagement situation between the coupling portion 55 (155) and the engagement mechanism 70 is incomplete with the indicator portion 75, so the likelihood of embroidery sewing being executed in a state where the engagement situation between the coupling portion 55 (155) and the engagement mechanism 70 is incomplete can be reduced.

When comparing the device 40 and the device 140, the release member 160 of the device 140 can move the embroidery frame that is mounted on the device farther in the removing direction R than the release member 60 of the device 40 can. Therefore, with the device 140, the embroidery frame does not need to be pulled out as much from the holder after operating the release member, compared to with the device 40. When comparing the device 40 and the device 140, the release member 60 of the device 40 has fewer parts than the release member 160 of the device 140. The release member 60 of the device 40 thus enables the configuration of the release member to be simpler than the release member 160 of the device 140.

An embroidery frame transport device of the present disclosure are not limited to the above described embodiment, and various changes may be made without departing from the spirit and scope of the present disclosure. For example, the following modifications (A) and (B) may be added as appropriate.

(A) The configuration of the sewing machine 1 may be amended as appropriate. The sewing machine 1 may be an industrial sewing machine or a multi-needle sewing machine. It is sufficient that the device be such that the holder is configured to move relative to the needle bar in a first direction and a direction intersecting the first direction. The device 40 may be integrally formed with the sewing machine 1. The embroidery frame that can be mounted on the device 40 need only include the first frame, the second frame, and the coupling portion, and may be an embroidery frame that clamps the sewing object in the up-down direction, for example. The size and shape of the embroidery frame may be changed as appropriate. The configuration of the coupling portion of the embroidery frame may be changed as appropriate. The shape and position of the recessed portion of the coupling portion may be changed as appropriate.

(B) The engagement mechanism 70 may be configured to engage with the coupling portion by moving the embroidery frame in the mounting direction, to restrict the embroidery frame from moving in the removing direction R. When the engagement mechanism 70 includes the engagement member 71 and the first urging member 77, the configurations of both the engagement member 71 and the first urging member 77 may be changed as appropriate. For example, the engagement member 71 need not necessarily include at least one of the engagement portion 73, the contact portion 74, and the indicator portion 75. When the engagement member includes the indicator portion, the configuration of the indicator portion may be changed as appropriate. For example, the indicator portion may be configured such that the color visible to the user changes according to the position of the engagement member.

(C) The release member 60 (160) need only be provided on the holder 43 (143), and be configured to release engagement between the engagement mechanism 70 and the coupling portion 55 (155), as well as press the embroidery frame 50 (150) in the removing direction R. The movable range of the release member 60 (160) may be changed as appropriate. The release member may be provided on the holder in a manner configured to slide, not swing, from the first position to the third position. The second urging member may be omitted as necessary. While the release member 60 moves from the second position to the third position, the release member 60 may maintain a state in which engagement between the engagement mechanism 70 and the coupling portion 55 is released, or a member other than the release member 60 (for example, the coupling portion 55 of the embroidery frame 50) may maintain a state in which engagement between the engagement mechanism 70 and the coupling portion 55 is released.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame transport device comprising:

a carriage configured to detachably mount with a coupling portion of an embroidery frame;

an engagement mechanism configured to engage with the coupling portion by moving the embroidery frame in a mounting direction in a case where the coupling portion is mounted on the carriage, to restrict the embroidery frame from moving in a removing direction, the removing direction being in a direction opposite of the mounting direction, the engagement mechanism being provided on the carriage; and a release member configured to release engagement between the engagement mechanism and the coupling portion, the release member being provided on the carriage, the release member being configured to press the embroidery frame in the removing direction, the release member being attached to the carriage in a manner configured to move to a first position, a second position, and a third position, the first position being a position in which the release member is retracted from the engagement mechanism, the second position being a position in which the release member contacts the engagement mechanism to release engagement between the coupling portion and the engagement mechanism, and the third position being a position in which the release member contacts the coupling portion in a state in which engagement between the engagement mechanism and the coupling portion is released.

2. The embroidery frame transport device according to claim 1, wherein the engagement mechanism includes an engagement member and a first urging member, the engagement member being swingably supported by the carriage, the engagement member having an engagement portion configured to engage with a recessed portion provided on the coupling portion of the embroidery frame, the engagement portion being provided on one end portion of the engagement member, the engagement member having a contact portion configured to contact the release member, the contact portion being provided on the other end portion of the engagement member, the first urging member being configured to urge the engagement portion toward the coupling portion.

3. The embroidery frame transport device according to claim 2, wherein the release member releases the engagement between the engagement portion and the recessed portion by contacting the contact portion of the engagement mechanism and moving the engagement portion in a direction away from the recessed portion against urging force of the first urging member, in a case where the release member is moved from the first position to the second position.

4. The embroidery frame transport device according to claim 2, wherein the release member is a lever member swingably supported by the carriage, the release member including a cam portion and a pressing portion, the cam portion being configured to contact the contact portion, the pressing portion being configured to contact the coupling portion to press the embroidery frame in the removing direction while the release member moves in a direction from the second position toward the third position through a range where the release member is in the third position.

5. The embroidery frame transport device according to claim 1, further comprising:

a second urging member configured to urge the release member in a direction toward the first position from the second position.

6. The embroidery frame transport device according to claim 1, wherein the engagement mechanism includes an indicator portion configured to indicate an engagement situation with the coupling portion.

* * * * *